US005375356A

United States Patent [19]

Arjomand

[11] Patent Number: 5,375,356

[45] Date of Patent: Dec. 27, 1994

[54] STREET SIGN WITH STRIPES

[76] Inventor: Ahmad Arjomand, P.O. Box 193, Fort Lauderdale, Fla. 33302-0193

[21] Appl. No.: 684,860

[22] Filed: Apr. 15, 1991

[51] Int. Cl.[5] ..... G09F 19/22

[52] U.S. Cl. ..... 40/612; 283/117

[58] Field of Search ..... 40/612, 615, 584, 611; 404/1, 9; 283/117; D20/17; D10/109

[56] References Cited

U.S. PATENT DOCUMENTS

| | | | |
|---|---|---|---|
| D. 55,631 | 7/1920 | McMullan et al. | D10/109 |
| D. 56,102 | 8/1920 | McMullan et al. | D10/109 |
| D. 192,833 | 5/1962 | Sanford | D20/17 |
| D. 273,799 | 5/1984 | Darrell | D10/109 X |
| 577,253 | 2/1897 | Haupt | 283/117 |
| 1,199,368 | 9/1916 | Gilson | 283/117 X |
| 3,350,805 | 11/1967 | Jorgensen | 40/595 |

FOREIGN PATENT DOCUMENTS

| | | | |
|---|---|---|---|
| 274976 | 7/1988 | European Pat. Off. | 404/9 |

*Primary Examiner*—Kenneth J. Dorner
*Assistant Examiner*—J. Silbermann

[57] ABSTRACT

A street direction indicator for displaying both the name of the street and direction thereof includes a surface having inscribed thereon the name of the street and one or more stripes, said stripes being oriented parallel to the direction of the street indicated on the surface,

12 Claims, 3 Drawing Sheets

STREET SIGN WITH STRIPES

BACKGROUND OF THE INVENTION

This invention relates to a method of writing, printing stamping or painting street signs using stripe-like geometric patterns upon the street sign as either a background to the alphanumeric lettering or within suitable alphanumeric lettering.

Signs of the inventive type may be employed both in connection with otherwise conventional signs and upon the pavement at or near an intersection.

A need for the signs of the instant type derives that, in the positioning of the prior art street signs whether such signs be a conventional vertical sign or sign of the type painted upon the pavement, the mere use of an arrow in connection with the alphanumeric content of the sign is often insufficient to advise one not familiar with an area of the actual direction in which a street may run. In effect, street signs as they have existed in the prior art of value primarily to those already having a substantial knowledge of the neighborhood in which the sign is located.

The present invention seeks to respond to the above a problem in the prior art by providing a type of street sign that can provide to the observer more complete and more accurate information respecting the direction or axis of the street which the alphanumeric content of the street sign seeks to identify.

SUMMARY OF THE INVENTION

The present invention relates to street direction indicator for displaying both the name of a particular street and direction or axis thereof. Said street sign more particularly includes a surface having inscribed thereof a plurality of stripes, in which said stripes are oriented substantially parallel to the direction of the street, the name of which appears on said surface of said direction indicator.

It is accordingly an object of the present invention to provide a street direction indicator to more particularly identity the axis or direction of the street which the alphanumeric content of a street sign corresponds.

It is another object of the present invention to provide a type of street direction indicator in which the alphanumeric content of the street sign also provides information respecting the axis or directionality of the displayed street name.

The above and yet other objects and advantages of the present invention will become apparent from the hereinafter said forth a Brief Description of the drawings, the Detailed Description of the invention, and claims appended herewith.

DETAILED DESCRIPTION OF THE INVENTION

Figure 1:
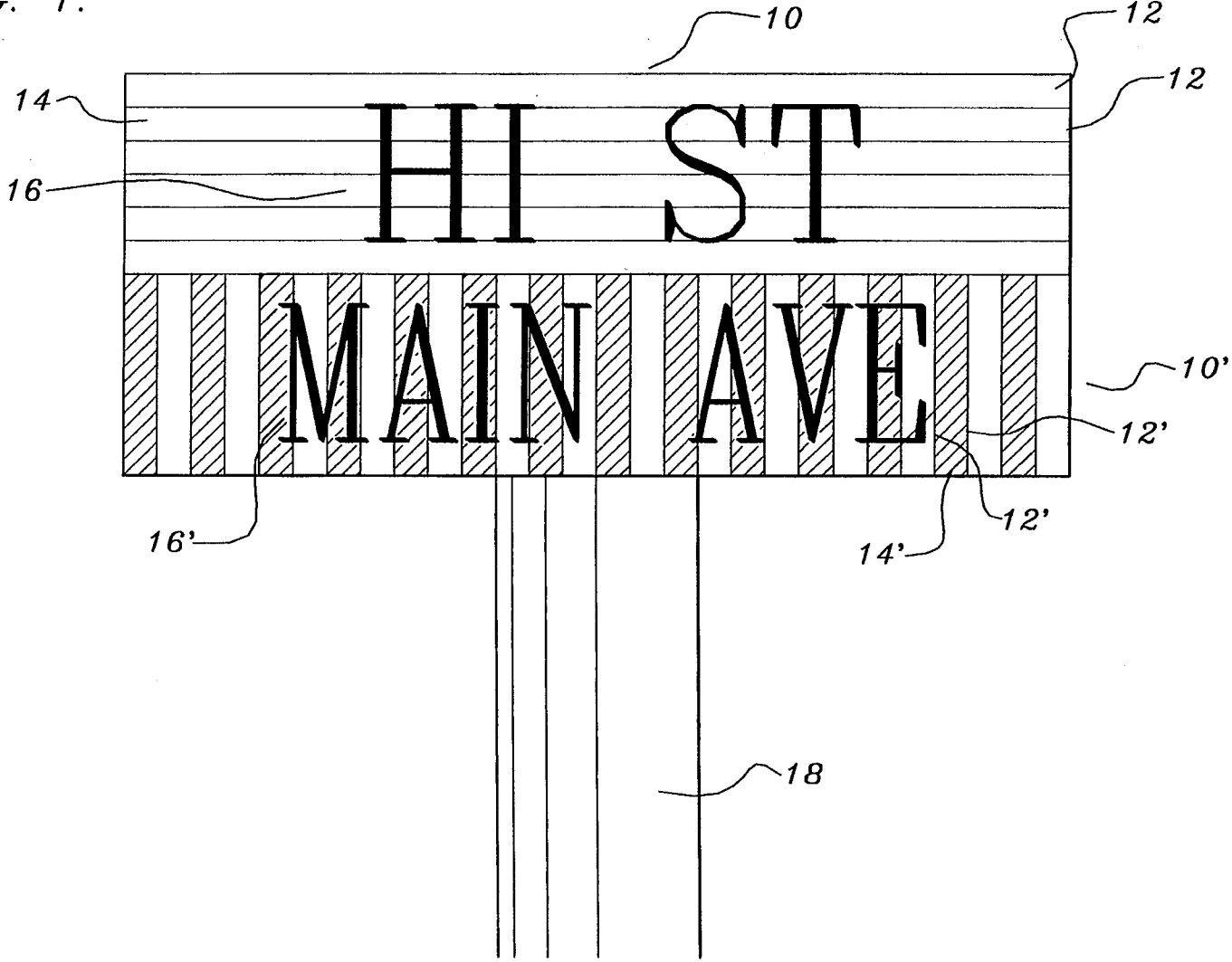
FIG. 1 is a front plan view of a vertical sign embodiment of the present invention having stripes upon the surface of the particular sign.

With reference to FIG. 1, a street direction indicator, i.e., a street sign is seen to include a surface 10, having inscribed thereon a plurality of stripes 14.

As may be noted from FIG. 1, said stripes 14 may be oriented horizontally or vertically. Further, it is to be understood that in a given application, said stripes 14 may be oriented at an angle other than horizontal or vertical.

Inscribed upon each surface 10 is the name 16 of the street which corresponds in directionality to the direction of the stripes 14, defined by parallel lines 12. Accordingly, if the direction of the street is left and right relative to the position of an observer, the stripes 14 will be horizontal, as in the illustrated name Hi Street.

However, if the street is co-directional with the direction from which the signs is being observed, as is the case with Main Avenue 16', the stripes 14' will be in alignment with pole 18.

As an additional embodiment of the invention, the stripes 14 and 14' may comprise multi-colored stripes accordingly to any one of a number of patterns. In the patterns shown in regard to "Main Avenue" in FIG. 1, the vertical stripes 14' are alternatively dark and light colored.

Figure 2:
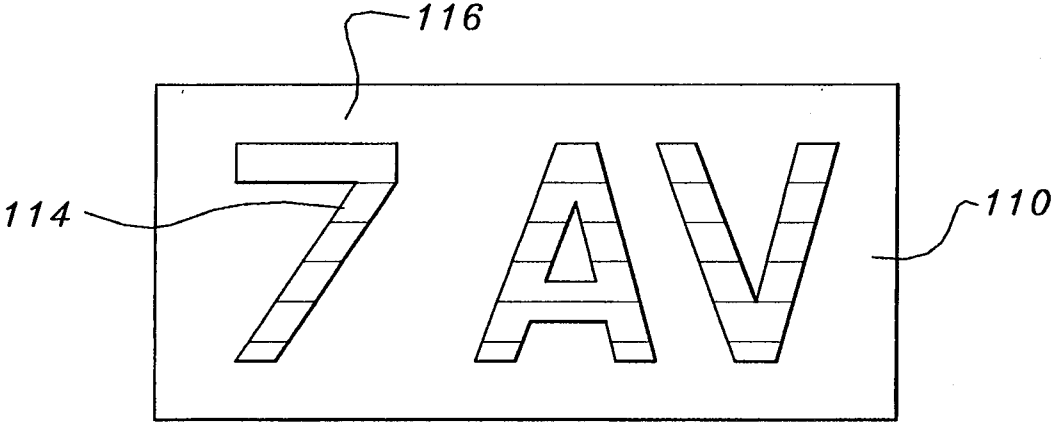
FIGS. 2 and 3 are plan views of a second embodiment of the instant invention in with which the stripes are internal to the alphanumeric lettering of the sign.
Figure 3:
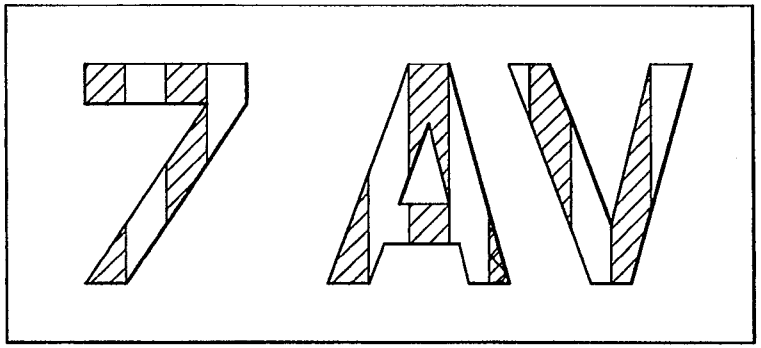

With reference to FIGS. 2 and 3, there is shown a further embodiment of the present invention in which the extent of the stripes is confined to the extent of the alphanumeric lettering 116. That is, stripes 114 are provided only within the physical extent of the alphanumeric letters 116 which comprise the name of the street, the direction or axis of which is parallel with the axis of said stripes 114. As may be noted in FIGS. 2 and 3, the axis of the stripes 114 may be vertical as well as horizontal.

Figure 4:
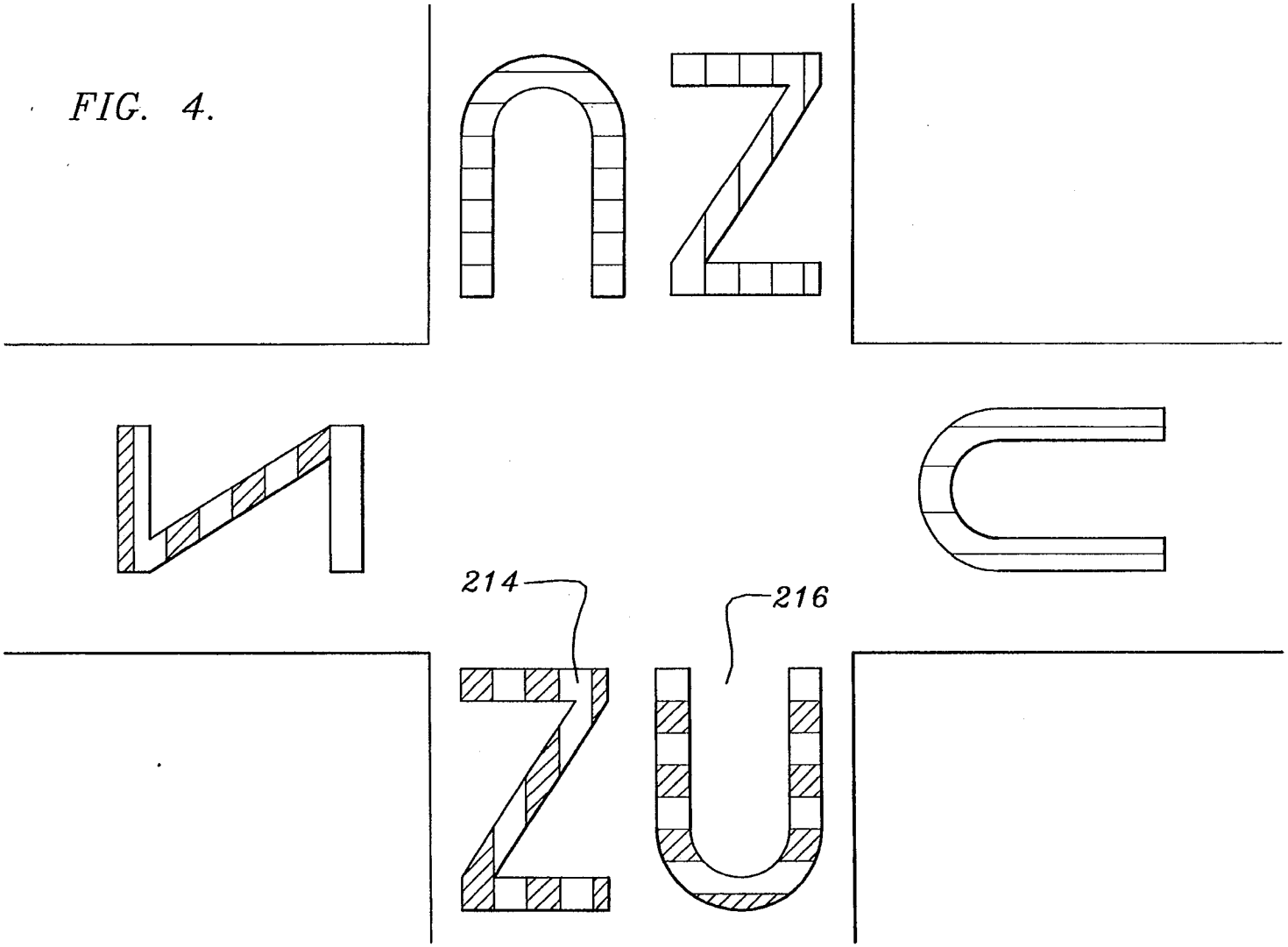
FIG. 4 is a plan view of a horizontal application of the embodiment of FIGS. 2 and 3.

With reference to the view of FIG. 4, it is noted that the concept of the embodiment of FIGS. 2 and 3 may be applied directly to the surface of a street or roadway, preferably near an intersection in order to advise the driver approaching the intersection of the axis or directionality of the streets which comprise the intersection. As may be noted, alternate light and dark coloring may be employed as between adjacent stripes 214 to highlight the directionality of the stripes 214.

It is further to be appreciated that the embodiments of the invention as above said forth may be applied in other types of direction indicating situation, for example, the identification of names and directions of hallways and corridors in large buildings.

Accordingly, while there has been shown and described the preferred embodiment of the present invention it is be appreciated that the invention may be embodied otherwise than is herein specifically shown and described and that, within such embodiments certain changes may be made within detail and construction thereof without departing from the underlying idea of this invention within the scope of the claims appended herewith.

Having thus described my invention, what I claim as new, useful, non-obvious and, accordingly, secure by Letters Patent of the United States is:

1. A street direction indicator for displaying both the name of a street and the longitudinal direction thereof, said indicator comprising:

(a) a surface having inscribed thereon said name of said street, said means comprising a plurality of letters; and (b) at least co-extensive with said letters of said street name, a plurality of substantially parallel lines, defining a corresponding plurality of linear sub-surfaces in the nature of stripes in which a longitudinal axis of each of said linear sub-surfaces is oriented substantially parallel to the direction of said street to be indicated.

2. The street direction indicator as recited in claim 1 in which said inscribed surface comprises a street sign surface.

3. The street indicator as recited in claim 2 in which said stripes comprises alternate light and dark colored stripes.

4. The street direction indicator as recited in claim 3, further comprising:

(a) a second surface, proximal to said first surface, having linear sub-surfaces therein, each sub-surface having a longitudinal axis thereof parallel to a longitudinal axis of a second street, the name of which is inscribed upon said second surface.

5. The street direction indicator as recited in claim 1 in which said inscribed surface comprises a surface of said street to be indicated.

6. The street indicator as recited in claim 5 in which said stripes comprise alternately light and dark colored stripes.

7. The street direction indicator recited in claim 1 in which said street surface comprises an approach to an intersection, one street of which includes the indicated street to be named.

8. A street-direction indicator for displaying both the name of the street and the direction thereof, said indicator comprising:

a surface having inscribed thereon lettering corresponding to the name of said street, said lettering having therewithin a plurality of substantially parallel lines, defining, within said area of said lettering a corresponding plurality of linear sub-surfaces, each having a major axis parallel to said parallel lines, in which each of said axle is oriented substantially parallel to the direction of the street, the name of which is inscribed upon said surface.

9. The street direction indicator as recited in claim 8, in which said surface comprises a street sign.

10. The street direction indicator as recited in claim 8, in which said surface comprises a surface of a street.

11. The street direction indicator as recited in claim 8, in which said street surface comprises a location near an intersection which includes the indicated street.

12. The street indicator as recited in claim 11, further comprising:

a second surface, proximal to said first surface, having linear sub-surfaces, each having axes thereof parallel to a second street, the name of which is inscribed upon said second surface.

* * * * *